United States Patent [19]

Reid

[11] Patent Number: 4,595,094

[45] Date of Patent: Jun. 17, 1986

[54] DISPLAY STAND FOR AN ICE CARVING OR LIKE STRUCTURE

[75] Inventor: Winston Reid, Miami, Fla.

[73] Assignee: Poseidon Maritime Services, Inc., Miami, Fla.

[21] Appl. No.: 801,708

[22] Filed: Nov. 26, 1985

[51] Int. Cl.[4] ..... B65D 5/50

[52] U.S. Cl. ..... 206/45.14; 206/45.33; 220/DIG. 6; 362/134; 362/382

[58] Field of Search ..... 206/45.14, 423, 45.33, 206/216; 362/134, 382; 220/DIG. 6

[56] References Cited

U.S. PATENT DOCUMENTS

| | | | |
|---|---|---|---|
| 2,674,687 | 4/1954 | Priebe | 362/134 |
| 3,125,065 | 3/1964 | Willinger | 206/45.14 |
| 3,358,819 | 12/1967 | Johnson | 206/45.14 |
| 3,682,347 | 8/1972 | Barrier | 206/423 |
| 3,800,471 | 4/1974 | Adams | 206/423 |
| 3,852,912 | 12/1974 | Diller | 206/423 |
| 3,902,599 | 9/1975 | Stromberg | 220/DIG. 6 |
| 4,200,903 | 4/1980 | Koenig et al. | 362/134 |

*Primary Examiner*—Joseph Man-Fu Moy

*Attorney, Agent, or Firm*—John Cyril Malloy

[57] ABSTRACT

A display and support assembly specifically designed to have ice sculptures or like objects, made from a "meltable" material at room temperature, mounted thereon wherein a collecting trough is built into a supporting housing in immediately adjacent and surrounding relation to the periphery of a support platform on which the object is mounted. An illumination assembly is disposed on the interior of the housing so as to direct light up through a supporting and retaining portion of a platform on which the sculpture is mounted. Accordingly, leakage, due to dripping, is eliminated through the collection thereof in the trough and display is enhanced through illumination of the ice sculpture.

15 Claims, 8 Drawing Figures

DISPLAY STAND FOR AN ICE CARVING OR LIKE STRUCTURE

BACKGROUND OF THE INVENTION

1. Field of the Invention

This invention relates to a support structure, particularly for an ice sculpture or like object wherein water draining from the sculpture, due to melting, is efficiently collected thereby eliminating mess, due to leakage while enhancing the aesthetic appearance of the display through the provision of illumination of the sculpture by light directed through the platform on which it is mounted.

2. Description of the Prior Art

Numerous types of display stands are available in the prior art for mounting, supporting and generally displaying various articles. Typically, such devices are used in retail outlets for the display of products for sale. Also, many of the prior art structures are illuminated in order to enhance the overall aesthetic appearance of the object being displayed as well as draw attention to the object by having light or illumination being directed thereon.

Certain objects present somewhat unusual or unique problems in their display such as when food or generally perishable items are displayed for sale, decoration or prior to consumption. A special area of this type is the display of ice sculptures. Typically, such sculptures are used to decorate food displays such as banquet tables or the like during parties or other festive occasions.

One problem obviously associated with the presentation and display of ice sculptures is the collection and maintenance of water drippings. Other prior art techniques utilized to display such perishable objects result in a general messiness and a requirement to constantly clean around the support pedestal or stand. While in the creation and display of ice sculptures of generally acceptable or conventional sizes, the sculptures of course do not immediately melt. However, over a period of time, the collection of drainage from the ice sculpture is substantial. Such drainage requires constant cleaning of the display stand and surrounding areas.

Another problem generally associated with display and support of such objects is achieving proper illumination, through disposition of lighting in or around the display stand. Because of the drainage problem, as set forth above, electrical interconnection of lighting facilities with a conventional outlet is difficult and sometimes dangerous.

The following United States patents are generally representative of containers and/or display and support structures known in the prior art: 2,006,827; 2,008,619; 3,662,912; and 4,392,571.

Accordingly, there is a need in the art for a support and display structure capable of illuminating an ice sculpture while at the same time maintaining its support at a location where water draining from the sculpture is efficiently collected without spillage or water damage to the surrounding areas.

SUMMARY OF THE INVENTION

The present invention is directed towards a support and display assembly specifically designed to have an ice sculpture or like object mounted thereon for visual display. Typically, such ice sculptures are used to adorn food settings such as banquet or buffet tables, etc. at festive activities or in restaurants.

Accordingly, the support assembly of the present invention comprises a housing having a substantially hollow interior portion in which an illumination assembly is mounted. In addition, a support platform is made, at least in part, from a light permeable material such as transparent or translucent plastic. The platform is specifically structured to include a retaining portion on which the ice sculpture, or like object, is preferably centered. This retaining portion is located in overlying relation to the hollow interior portion so as to be in light receiving relation to the illumination assembly when the latter is activated. Therefore, light passing through the retaining portion of the support platform fully illuminates the ice sculpture. Due to the fact that the ice itself will transmit the directed light throughout the sculpture, the aesthetic appearance of the ice sculpture is greatly enhanced thereby adding to the decorative appearance of the display of which it is a part.

The housing further includes a collection means in the form of a continuous trough disposed immediately adjacent and in surrounding relation to the peripheral edge of the support platform. In such disposition, any water, draining from the sculpture, will pass over the periphery of the support platform and be collected into the surrounding trough. The trough may be specifically dimensioned to hold enough water to accommodate the expected drainage from the sculpture at normal or expected room temperature.

Accordingly, the support and display assembly of the present invention enhances the aesthetic appearance of the ice sculpture, or like object being displayed by fully illuminating the sculpture. At the same time, water melting from the sculpture is readily collected in the surrounding collecting trough built into the housing so as to eliminate any water damage to the supporting surface, such as a table, or adjacent decorative display. Further, structure is provided in the housing to isolate the electrical interconnection of the illumination means with a conventional electrical power source from the collected water maintained in the trough in order to prevent damage to the electrical portion of the assembly and possible harm or danger to users of the subject assembly.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller undertanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
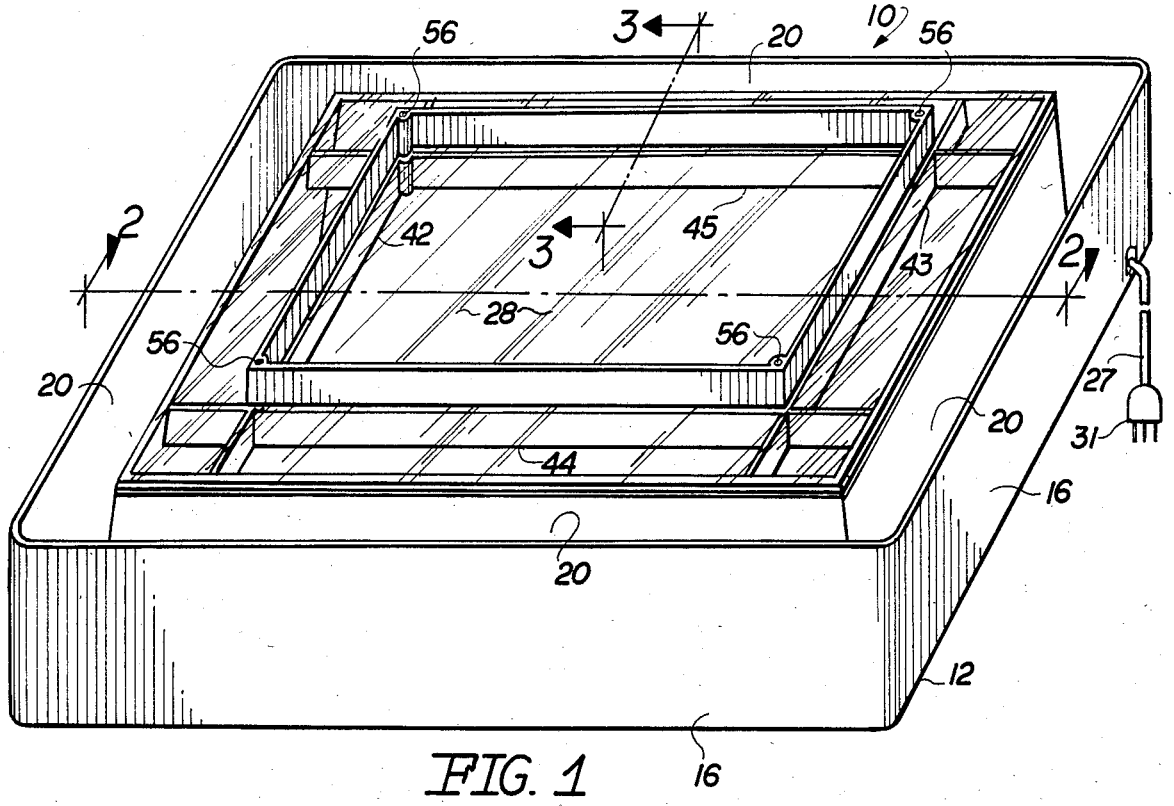
FIG. 1 is an isometric view of the subject support and display assembly showing the support platform in surrounding collection trough.
Figure 2:
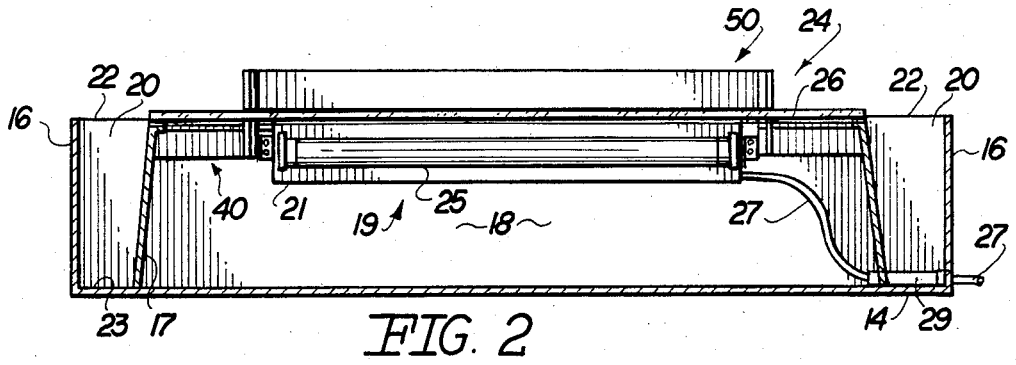
FIG. 2 is a sectional view along line 2—2 of FIG. 1 showing interior structural details of the subject assembly.
Figure 3:
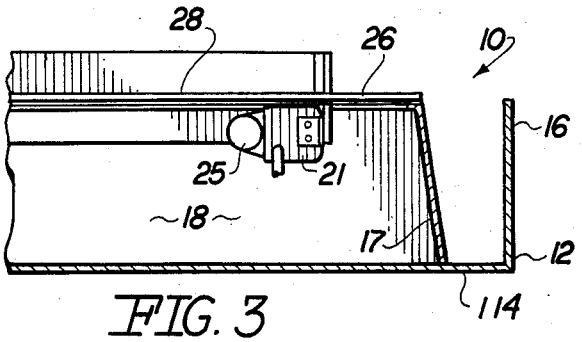
FIG. 3 is a sectional view in partial cutaway along line 3—3 of FIG. 1.
Figure 4:
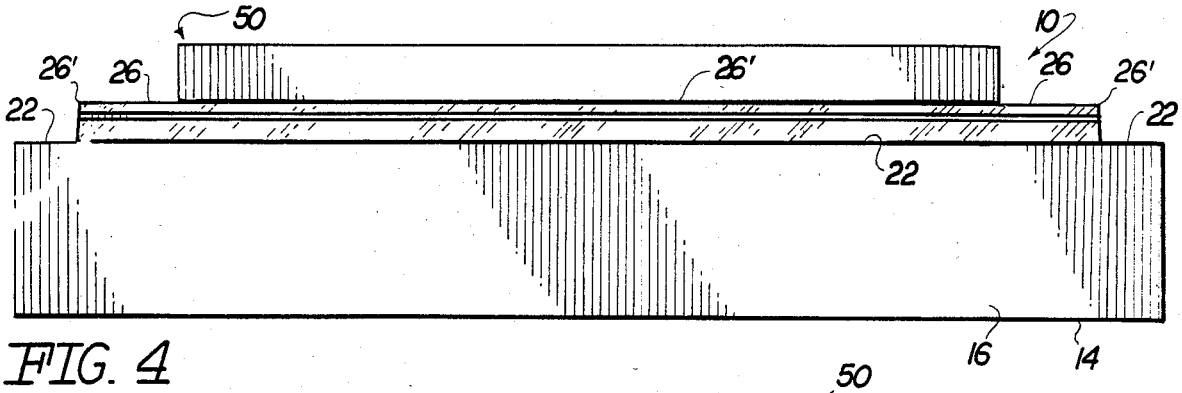
FIG. 4 is a side view of the embodiment of FIG. 1.
Figure 5:
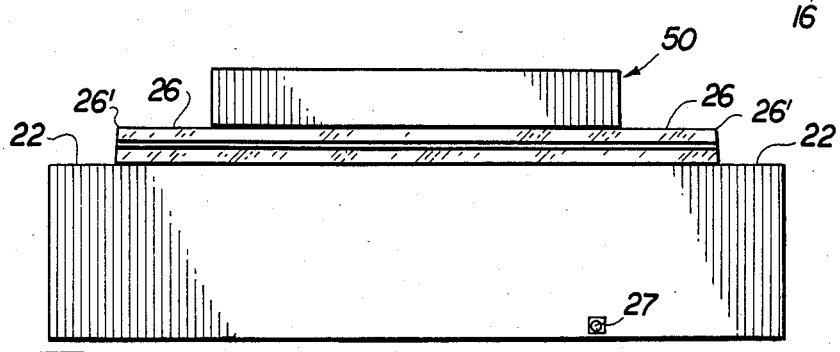
FIG. 5 is an end view of the embodiment of FIG. 1.

The assembly as shown in FIGS. 1 through 8 is generally indicated as 10 and includes a housing 12 having an undersurface 14, which may be of varying configurations, designed to rest on a table or like support surface and thereby maintain the assembly 10 in an upright orientation as shown in FIG. 1.

The housing 12 includes a substantially continuous lateral wall 16. The continuous lateral wall surface 16 has a multi-sided configuration but of course may vary depending on the particular design and application preferred. The lateral wall is disposed in surrounding relation to a hollow interior portion 18 in which a lighting assembly generally indicated as 19 may be mounted as described in detail hereinafter.

A collection means is formed in the housing 12 and includes a collection trough 20 having an open mouth 22 extending along the upper end thereof. The trough 20 extends down to a base portion 23 thereof which may be located substantially adjacent to the undersurface 14 of the housing 12, but of course on the interior thereof. The open mouth 22 of the collection trough 20 is disposed immediately adjacent to and in surrounding relation to a support platform generally indicated as 24. The support platform 24 includes, in the preferred embodiment, a one piece plastic or like rigid material sheet 26 extending in overlying relation to the hollow interior portion 18. The support platform 26 includes a retaining portion 28 substantially centered in the middle of the support platform 26. In a preferred embodiment of the present invention, at least the retaining portion 28 of the support platform 26 is formed from a light permeable material. Such material may be either transparent or translucent, again depending upon the particular preference of the user and upon the application intended. However, the entire support platform 26 may be formed from a one piece construction wherein the entire sheet is light permeable. By virtue of this construction the illumination means generally indicated as 19 may be disposed on the interior portion 18 of the housing 12 so as to direct light up through the retaining portion 28 on which the object to be displayed or ice sculpture (not shown) is centered. As shown in FIGS. 2, 3, 6 and 7, the illumination means 19 includes at least one illumination assembly 21 having an illuminated bulb 25 powered by a conventional connector 27 passing through trough 20 by means of a water tight sheath or sleeve 29 and extending outwardly from the exterior surface of one of the lateral walls 16 so as to be connected to a conventional electrical outlet by plug member 31.

Figure 6:
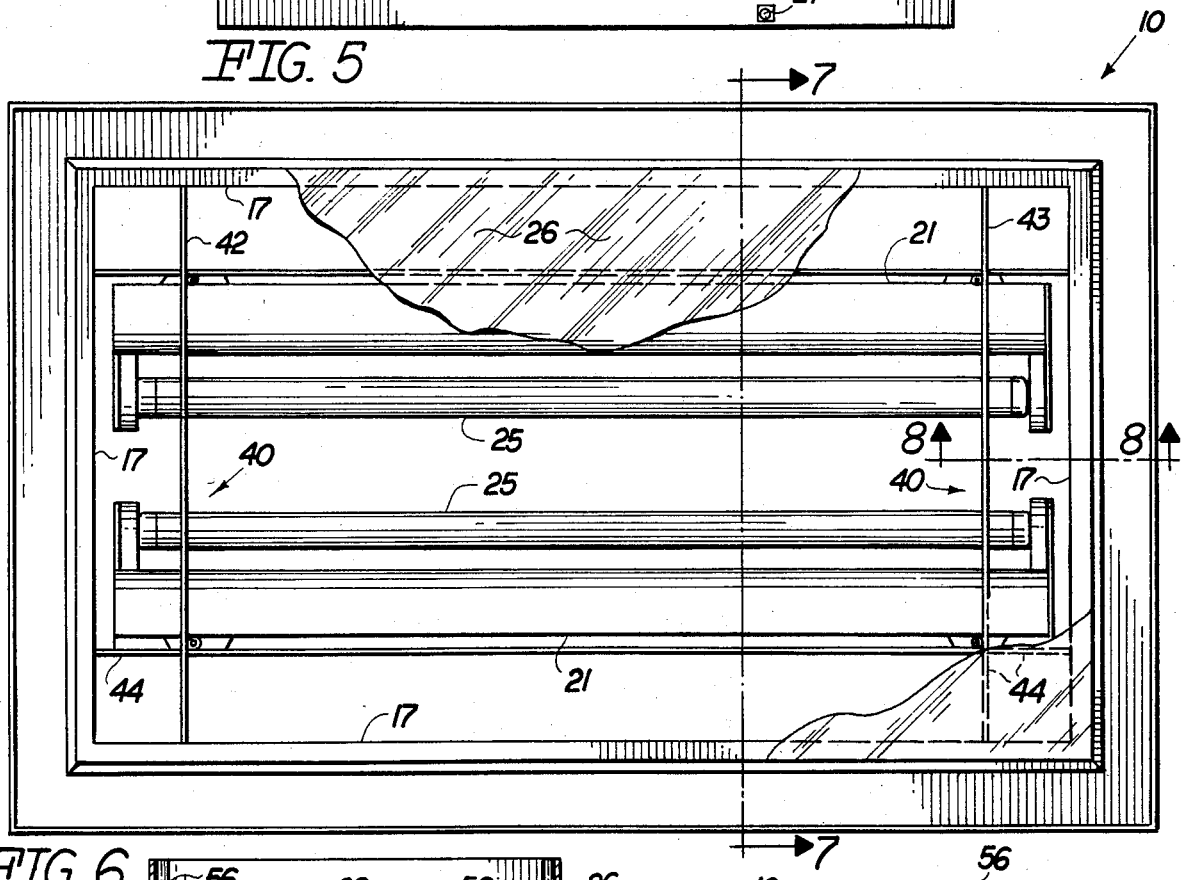
FIG. 6 is a top view with the support platform at least partially cutaway showing the interior details of the housing and the illumination structure mounted therein.
Figure 7:
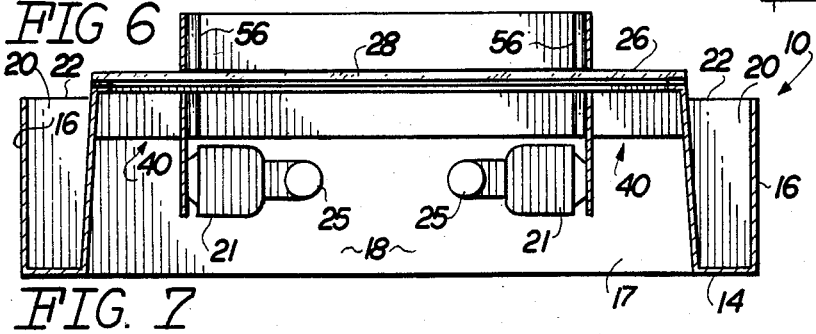
FIG. 7 is a sectional view along line 7—7 of FIG. 6.
Figure 8:
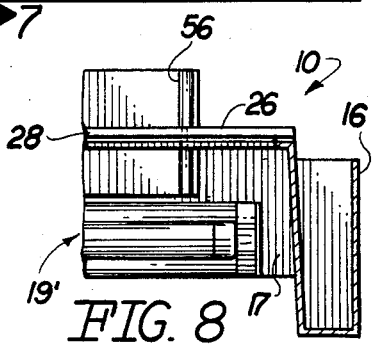
FIG. 8 is a sectional view in partial cutaway along line 8—8 of FIG. 6.

In the embodiment of FIGS. 6 and 7, an illumination assembly 21 including bulbs 25 may be mounted so as to extend substantially immediately beneath the retaining portion 28. The retaining portion is light permeable, so as to allow light to pass directly therethrough onto the ice sculpture supported or centered thereon. In another embodiment, the illumination means is generally represented as 19′ and shown in FIG. 8. It may be connected to the inner surface 17 of the interior portion 18 of the housing and thereby serve to direct light not only through retaining portion 28 but through the entire light permeable support platform 26.

Another feature of the present invention is the provision of a support frame 40. The support frame includes two pairs of support legs 42, 43, and 44, 45. Each pair of support legs has the respective legs thereof disposed in parallel relation to one another wherein each pair is disposed in intersecting relation to the other pair substantially adjacent the ends thereof. The opposite longitudinal ends as best shown in FIGS. 1 an 6, extend outwardly into engaging relation with the inner surface 17 on the interior 18 of the housing 12. Also, the support frame 40 is disposed in supporting, engaging relation with the undersurface of the support platform 26.

In addition, the retaining frame 50 extends upwardly from the outer or exposed surface of the support platform 26 and is disposed in surrounding relation to the retaining portion 28 of the support platform. The retaining frame as well as the support frame may be made from a metal or like rigid material which are interconnected by a plurality of connecting pins 56 which defines a connecting means between the retaining frame 50 and the support frame 40. The connecting pins 56 are disposed at the corner or junction of each intersecting portion of the retaining frame 50. Each of the pins 56 has a mid portion passing through the support platform 26 such that its opposite ends extend outwardly from the undersurface thereof into fixed securement with a similarly disposed junctions of the legs 42, 43 and 44 and 45 of the support frame.

When an ice sculpture or like object is placed or centered on the retaining portion 28, light is of course directed upwardly therethrough so as to enhance the aesthetic appearance of the sculpture. Once the ice sculpture has remained in place for a length of time, it will of course begin to melt. Drippings coming from the ice sculpture will collect on the interior of the retaining frame 50. Once a sufficient amount of water has been collected, it will overflow the upper edges of the retaining frame 50 and pass onto the outer exposed surface of the support frame 26. The water or drippings will then pass over the peripheral edge 26′ into the open mouth 22 of the trough 20 and be collected therein. By virtue of this arrangement, the sculpture may be maintained on the retaining portion for an extended period without worry of overspill or leakage from the support assembly 10. As is obvious, the dimension and/or capacity of the trough 20 may of course be varied dependent upon the intended size of the sculpture so as to accommodate sufficient collection of water melting from the sculpture to prevent overflow.

It is therefore to be understood that the following claims are intended to cover all of the generic and specific features of the present invention herein described, and all statements of the scope of the invention which as a matter of language, might be said to fall therebetween.

Now that the invention has been described,

What is claimed is:

1. A support assembly primarily designed to support and display an ice sculpture or like object, said assembly comprising:

(a) a housing structured and disposed in engaging relation to a supporting surface and including a substantially hollow interior portion, (b) a support platform mounted on an upper portion of said housing in at least partially covering relation to said hollow interior portion and disposed to define an upper exposed surface of said housing, (c) said support platform formed at least in part from a light permeable material disposed in overlying relation to said hollow interior portion, (d) illumination means mounted witin said hollow interior portion and disposed to direct light through said light permeable material, whereby display of an object on said display platform is enhanced by illumination thereof, (e) collection means formed on said housing adjacent to and at least partially below said support platform for collection of liquid melted from the ice sculpture, (f) said collection means comprising a trough positioned immediately adjacent an outer peripheral edge of said support platform and in liquid receiving position for liquid falling from said support platform, whereby liquid draining from the ice sculpture will be collected in said trough.

2. An assembly as in claim 1 wherein said support platform comprises a retaining portion disposed in overlying relation to said hollow intrior portion, said retaining portion formed from said light permeable material and structured to support and substantially retain the ice sculpture for illuminated display.

3. An assembly as in claim 2 wherein said trough is disposed in substantially surrounding relation to said support platform and adjacent to and along a length of a periphery of said support platform and in liquid receiving relation thereto.

4. An assembly as in claim 3 wherein said trough is fixedly secured to said housing and includes an open mouth extending along the length thereof and disposed continuously, immediately adjacent to said periphery of said support platform, said trough extending downward from said support platform to a base portion of said trough located below said support platform.

5. An assembly as in claim 1 further comprising a support frame fixedly secured to said housing and extending over said hollow interior portion and in supporting engagement with an undersurface of said support platform.

6. An assembly as in claim 5 wherein said support platform comprises a retaining portion disposed in overlying relation to said hollow interior portion and formed from said light permeable material and disposed for illumination of an ice sculpture thereon for said illumination means.

7. An assembly as in claim 6 further comprising a retaining frame secured to an exposed surface of said platform and extending outwardly therefrom in surrounding relation to said retaining portion.

8. An assembly as in claim 7 further comprising connecting means for securing said retaining frame on said support platform and being interconnected between said retaining frame and said support frame and structured to extend through said support platform.

9. An assembly as in claim 8 wherein said connecting means comprises a plurality of connecting pins each including a mid portion passing through said support platform and having opposite ends thereof secured to said support frame and said retaining frame respectively.

10. An assembly as in claim 5 wherein said support frame comprises two pairs of support legs, each leg of the respective pairs disposed in parallel relation to one another and each pair of support legs disposed in intersecting relation to one another; each support leg having opposite longitudinal ends extending to and disposed adjacent correspondingly positioned peripheral edges of said support platform.

11. An assembly as in claim 10 wherein said retaining frame comprises a multi-sided configuration disposed and structured in surrounding relation to a center portion of said support platform and thereby defining said retaining portion thereof.

12. An assembly as in claim 11 wherein said retaining frame corresponds in position and configuration to a central portion of said support frame and is disposed in coplanar relation thereto.

13. An assembly as in claim 10 wherein said illumination means is secured to oppositely disposed and parallel support legs and disposed to direct light up through said retaining portion.

14. An assembly as in claim 1 wherein said illumination means is secured below and outside of said support frame.

15. An assembly as in claim 1 wherein said support platform is formed from a one piece sheet of light permeable material.

* * * * *